US009775377B2

(12) United States Patent
Fritzsching et al.

(10) Patent No.: US 9,775,377 B2
(45) Date of Patent: Oct. 3, 2017

(54) TOBACCO PRODUCT WRAPPING MATERIAL WITH CONTROLLED BURNING PROPERTIES

(71) Applicant: Julius Glatz GmbH, Neidenfels (DE)

(72) Inventors: Thomas Fritzsching, Neustadt an der Weinstraβe (DE); Christoph Nover, Rheinberg (DE); Marijan Vucak, Altendiez (DE)

(73) Assignee: Julius Glatz GMBH, Neidenfels (DE)

( * ) Notice: Subject to any disclaimer, the term of this patent is extended or adjusted under 35 U.S.C. 154(b) by 137 days.

(21) Appl. No.: 14/529,530

(22) Filed: Oct. 31, 2014

(65) Prior Publication Data

US 2015/0114414 A1 Apr. 30, 2015

(30) Foreign Application Priority Data

Oct. 31, 2013 (EP) ..... 13191043

(51) Int. Cl.
*A24D 1/02* (2006.01)
*D21H 17/66* (2006.01)
(Continued)

(52) U.S. Cl.
CPC ..... *A24D 1/02* (2013.01); *D21H 17/66* (2013.01); *D21H 17/675* (2013.01); *D21H 17/69* (2013.01); *A24D 1/025* (2013.01)

(58) Field of Classification Search
USPC ..... 131/58, 105, 35, 8, 365; 162/139, 162/181.1–181.3; 108/400, 442, 444,
(Continued)

(56) References Cited

U.S. PATENT DOCUMENTS 4,044,778 A 8/1977 Cohn et al.
5,722,433 A * 3/1998 Ishino ..... A24D 1/02 131/331

(Continued)

FOREIGN PATENT DOCUMENTS

CN 101747909 6/2010
CN 102199902 A * 9/2011

(Continued)

OTHER PUBLICATIONS

"Bases—pH Values", The Engineering Toolbox, [online], retrieved from the Internet, [retrieved Dec. 16, 2016], <URL: http://www.engineeringtoolbox.com/bases-ph-d_402.html>.*

(Continued)

*Primary Examiner* — Dennis Cordray
(74) *Attorney, Agent, or Firm* — Doherty, Wallace, Pillsbury & Murphy, P.C.

(57) ABSTRACT

A tobacco product wrapping, material comprising composite particles is described, the composite particles being obtainable by a method in which an aqueous suspension containing calcium carbonate particles is prepared, and a metal salt comprising an aluminum cation is added. The metal salt is able to form a basic metal component in the suspension; and has a solubility of greater than 9.0 mg/L in water, measured at the pH value of the prepared suspension and at a temperature of 20° C. The invention further relates to a method for the production of the tobacco product wrapping material, the use of such tobacco product wrapping material for the production of tobacco products, and the tobacco products produced with the tobacco product wrapping material.

19 Claims, 5 Drawing Sheets

(51) Int. Cl.
*D21H 17/67* (2006.01)
*D21H 17/69* (2006.01)

(58) Field of Classification Search
USPC ..... 108/461, 463
See application file for complete search history.

(56) References Cited

U.S. PATENT DOCUMENTS

| | | | | |
|---|---|---|---|---|
| 7,219,672 | B2 * | 5/2007 | Tosas Fuentes | A24D 1/02 131/365 |
| 2003/0089377 | A1 | 5/2003 | Hajaligol Mohammad et al. | |
| 2004/0221861 | A1 | 11/2004 | Eibl | |
| 2006/0162884 | A1 | 7/2006 | Gane et al. | |
| 2007/0113997 | A1 * | 5/2007 | Glittenberg | D21H 19/54 162/175 |
| 2009/0266371 | A1 | 10/2009 | Fritzsching | |
| 2011/0180086 | A1 | 7/2011 | Fritzsching | |

FOREIGN PATENT DOCUMENTS

| | | | |
|---|---|---|---|
| EP | 1321048 | | 6/2003 |
| EP | 1 933 651 | | 6/2008 |
| GB | 1207220 | A * | 9/1970 |
| JP | 11-151082 | | 8/1999 |
| JP | 2005-281915 | | 10/2005 |
| JP | 2013-129562 | | 7/2013 |
| WO | WO 85/04080 | A1 | 9/1985 |
| WO | WO2007042077 | | 4/2007 |

OTHER PUBLICATIONS

"pH of Common Acids and Bases", aqion—Hydrochemistry, no date, [online], retrieved from the Internet, [retrieved Dec. 16, 2016], <URL: http://www.aqion.de/site/191>.*

Machine translation of CN 102199902, 12 pages, The European Patent Office, [online], [retrieved on Aug. 2, 2017]. Retrieved from the Internet: <URL: http://ep.espacenet.com/?locale=EN_ep>.*

International Search Report for PCT/EP2005/055198 dated Jul. 17, 2006.

Search Report for EP 14 19 1057 dated Feb. 13, 2015 (in German).

First Notification of Office Action issued on Application No. 201410602320.4. Issue No. 2016020101510180, Feb. 4, 2016, pp. 1-3; The English Translation of the Text of the First Office Action, pp. 4-11; Search Report, pp. 12-13.

* cited by examiner

TOBACCO PRODUCT WRAPPING MATERIAL WITH CONTROLLED BURNING PROPERTIES

BACKGROUND TO THE INVENTION

1. Field of the Invention

The present invention pertains to a tobacco product wrapping material comprising composite particles based on mineral particles, to a method for its production, and to its use in tobacco products. A main emphasis of the present application is on tobacco products with controlled burning properties.

2. Background of the Invention

Filter cigarettes usually consist of a cylindrical, round, or oval tobacco rod, which is wrapped by a cigarette paper; a similarly shaped filter plug, which is surrounded by a filter wrapping paper; and a tipping paper (base paper for the mouthpiece covering), which is usually glued to the entire filter wrapping paper and to part of the cigarette paper surrounding the tobacco rod and thus connects the filter plug to the tobacco rod. All these papers are to be designated in the following collectively as "tobacco product wrapping materials".

Tobacco product wrapping materials usually contain fillers. Other additives can also be present to achieve special properties; such additives include wet-strength agents, substances which retard the combustion rate, and/or substances which accelerate the combustion rate.

Substances such as calcium carbonate, titanium dioxide, aluminum hydroxide, magnesium hydroxide, kaolin, calcined kaolin, talc and their mixtures are usually incorporated as fillers into the tobacco product wrapping materials, wherein, by suitable selection of the type and quantity of the fillers, both the optical properties and the burning properties can be controlled. Tobacco product wrapping materials which comprise no filler or only a small amount of filler can have a strong self-extinguishing effect on tobacco products, but tobacco product wrapping materials of this type do not have the desired optical properties such as a high degree of whiteness and a high degree of opacity.

With respect to tobacco product wrapping materials, furthermore, there are also limitations on the fillers which are allowed for use under the various applicable legal regulations. Calcium carbonate, according to the applicable regulations, can be used without restriction in all types of tobacco product wrapping materials. It is known, however, that certain fillers are disadvantageous with respect to the optical properties and burning properties. It is also known that tobacco product wrapping materials which comprise a large amount of filler and which also show controlled burning properties and also a desired self-extinguishing behavior when used in tobacco products require, in addition to calcium carbonate, a considerable proportion of other fillers or mixtures of other fillers as well as possibly additional substances which can be incorporated into the tobacco product wrapping materials such as those which, for example, retard the combustion rate.

It is also known in the relevant technical field that substances such as polymers, silicates, and polysaccharides and their derivatives in aqueous or non-aqueous solutions or suspensions can be applied in sufficient quantity and with a suitable geometric distribution to a tobacco product wrapping material, preferably a cigarette paper, for the purpose of influencing the burning properties of the tobacco product wrapping material.

In recent years, additional requirements on tobacco articles such as cigarettes have been enacted. Thus it has recently become a requirement that a tobacco article which continues to burn without self-extinguishing when smoked under normal conditions must self-extinguish when the tobacco article is placed on a combustible material, the purpose being to prevent the combustible material from catching fire. In other words, a controlled burning behavior is desired, in which the tobacco product burns down unimpeded along with the tobacco product wrapping material in freely accessible air, whereas, when resting on substrates, which may themselves be combustible, self-extinguishes shortly after contact with these substrates.

Japanese Patent Application No. 11-151082 A discloses a cigarette with controlled burning properties, in which a number of ring-shaped areas (combustion control areas) is arranged a certain distance apart in the longitudinal direction of the cigarette. These ring-shaped areas are in turn coated with a suspension comprising an inorganic filler such as chalk, clay, or titanium oxide in a cellulose polymer.

European Patent Application EP 1 321 048 A1 describes a tobacco article with controlled burning properties comprising a cigarette paper coated with a combustion-regulating agent, which is said to adjust the burning behavior of the tobacco article. As examples of suitable combustion-regulating agents, the document lists proteins such as gelatins, casein, albumin, and gluten; polysaccharide thickeners such as starch, xanthan (Echo Gum), locust bean gum, guar gum (Guarpack), gum tragacanth, "Tara" gum, tamarind seed polysaccharides (glyloid), gum karaya, gum arabic, pullulan, dextrin, cyclodextrin (Oligoseven), and gum ghatti; gelling polysaccharides such as carrageenan, curdlan, agar, furcellaran, pectin, "Jeram" gum, and "Kelco" gel; lipids such as lecithin; natural, high-molecular derivatives such as carboxymethylcellulose, methylcellulose, and propylene glycol alginate ester; processed starches such as starch phosphate; synthetic high-molecular compounds such as poly(sodium acrylate) and various high-molecular emulsifiers; inorganic ammonium salts such as ammonium chloride, ammonium phosphate, ammonium hydrogen phosphate, ammonium dihydrogen phosphate, ammonium bromide, and ammonium sulfate; inorganic hydroxides such as barium hydroxide, calcium hydroxide, and aluminum hydroxide; and flame retardants from inorganic salts such as sodium borate, boric acid, zinc chloride, magnesium chloride, calcium chloride, and sodium sulfate. EP 1 321 048 A1 describes that one or more of said combustion-regulating agents can be used.

CN 101747909 B discloses a flame-retarding additive comprising calcium carbonate and magnesium hydroxide, obtainable by preparing a magnesium sulfate solution, adding an alkaline calcium hydroxide suspension, adding a calcium chloride solution, and separating the precipitated material.

The disadvantage of the procedure described in this publication is that the method is time-intensive and complicated, comprising as it does a total of 10 steps, wherein step 9 alone takes 2-3 days. In addition, step 4 calls for an ultrasound treatment, which is very difficult to realize on an industrial scale.

The product obtainable in this way, furthermore, is not able to release significant amounts of water until the temperature exceeds 200 degrees Celsius ("° C."). X-ray diffraction spectra of the product show that the product is a physical mixture of calcium carbonate and magnesium hydroxide.

In the U.S. Patent Application 2006/0162884 A1, mineral pigments are described, which contain a product obtained in situ by reaction of calcium carbonate with a weak or strong acid, gaseous carbon dioxide ("$CO_2$"), and a certain salt. The salt to be used can be aluminum silicate; synthetic silica; calcium silicate; a silicate of a monovalent salt such as sodium silicate, potassium silicate, and/or lithium silicate; aluminum hydroxide; sodium aluminate; and/or potassium aluminate, wherein the content of monovalent silicate salts should be less than 0.1 weight percent ("wt. %") based on the dry weight of the calcium carbonate. The mineral pigments obtainable in this way are said to have a pH, measured at 20° C., of greater than 7.5.

The BET surface area of the mineral pigment of this publication should preferably be in the range of 25-200 square meters per gram ("$m^2/g$").

In actual example 10 of this patent application, aluminum hydroxide powder and then sodium silicate are added to a suspension of natural calcium carbonate in water, and the resulting suspension is treated with phosphoric acid.

The addition of a metal salt to a calcium carbonate suspension, the salt having a solubility of greater than 9.0 milligrams per liter ("mg/L") in the suspension measured at 20° C., is not, however, mentioned anywhere in the publication.

This application, furthermore, does not deal with the technical field of the present invention, namely, making available tobacco articles with controlled burning properties; on the contrary, it pertains to the making available of fillers for inkjet papers and has the particular goal of improving the printability of conventional coated or uncoated papers.

Finally, there are substances which cannot be used for the purposes of the present invention, namely, those in which calcium silicates are formed as the primary or secondary product, because silicates are not allowed in cigarette papers under the current regulations in this area.

The product obtainable in this way, furthermore, is not able to release significant amounts of water until the temperature exceeds 200° C. X-ray diffraction spectra of the product show that the product is a physical mixture of calcium carbonate and magnesium hydroxide.

WO 03/034845 A describes cigarettes with an increased self-extinguishing tendency, wherein the cigarette paper comprises ring-shaped zones, the air permeability of which is lowered by the presence of a polymer. The polymers in question are in particular polyvinyl acetate, partially hydrolyzed polyvinyl acetate, and polyvinyl alcohol.

EP 1 933 651 A1 describes a tobacco product wrapping material involving a base wrapping material, onto which, at least in separate zones, a composition is applied which comprises mechanically fragmented, chemically crosslinked polysaccharide with a particle size (weight-average particle size) of the dry polysaccharide product in the range of 1-1,000 micrometers ("μm").

The fillers usually used in tobacco product wrapping materials thus suffer from limitations and disadvantages, especially because they do not make it possible to achieve effective control of the combustion behavior of the tobacco product wrapping material. It would be desirable, however, to have a tobacco product wrapping material comprising fillers in which the combustion behavior of the tobacco product wrapping material can be controlled effectively by the filler.

Against this background, better possibilities for reducing the flammability of combustible articles are to be presented. What is desired in particular are better solutions for controlling the burning properties and the self-extinguishing behavior of tobacco articles, above all better solutions for controlling the burning properties of tobacco articles in such a way that the tobacco articles burn under normal smoking conditions without self-extinguishing to the extent possible but do self-extinguish on contact with some other combustible material whose ignition is to be prevented as effectively as possible; that is, the tobacco product should burn down unhindered in the open air but self-extinguish on substrates which can themselves be combustible. It should be possible to realize the inventive solution in the simplest possible manner and at the lowest possible cost, and it should also be applicable universally to the extent possible.

SUMMARY OF THE INVENTION

This and other objects, which can be derived directly from the relationships discussed in the description of the invention, are achieved by the provision of a tobacco product wrapping material with all the features of the present claim 1. The subclaims referring to claim 1 describe preferred embodiments of the inventive tobacco product wrapping material. In the remaining claims, especially advantageous methods for the production of the inventive tobacco product wrapping material, the use of the inventive tobacco product wrapping material, and tobacco products produced with the use of the inventive tobacco product wrapping material are put under protection.

As a result of the composite particles used according to the invention, i.e., particles which are obtainable according to a method in which:

(a) an aqueous suspension containing calcium carbonate particles is prepared, and (b) a metal salt comprising an aluminum cation is added, wherein the metal salt (i) is able to form a basic aluminum component in the suspension and (ii) has a solubility of more than 9.0 mg/L in water, measured at the pH of the prepared suspension and at a temperature of 20° C., an additive is made available in a manner not directly predictable, namely, an additive by means of which the flammability, the burning properties, and the self-extinguishing behavior of the tobacco product wrapping material can be effectively controlled. The use of the composite particles used according to the invention makes it possible in particular to control in superior fashion the burning properties of tobacco articles, wherein the tobacco articles, when smoked under normal conditions, burn without self-extinguishing to the extent possible but do self-extinguish on contact with some other material whose ignition is to be prevented to the extent possible; that is, the present invention makes it possible to provide tobacco products which burn down unhindered in the open air but self-extinguish on substrates which can themselves be combustible. The inventive solution can be realized in the simplest possible manner at extremely low cost and is universally applicable.

Compared with the prior art, especially that according to the methods for controlling the burning properties of conventional tobacco articles described in patent applications JP 11-151082 A and EP 1 321 048 A1, the advantages of the present invention are to be seen in particular in that the composite particles used according to the invention can substitute for the filler to be used in any case in a tobacco product wrapping material. In the ideal case, only one additive, namely, the inventively used composite particles, are employed, thus leading to the corresponding process technology-related advantages.

Compared with powders comprising a physical mixture of calcium carbonate and a basic metal component such as aluminum hydroxide or magnesium hydroxide, the inventively used composite particles offer several advantages. In particular, they make it possible to achieve a better and more efficient control of the burning properties of tobacco articles.

With respect to the production of tobacco articles, one can profit from the fact that basically the same filler, namely, calcium carbonate ("$CaCO_3$") can be used as before, with the result that the already existing methods for the production of tobacco articles require only minor modification if any at all. The composite particles used according to the invention are easy to handle and show very good compatibility and excellent mixing behavior, especially with long-fiber pulps.

BRIEF DESCRIPTION OF THE DRAWINGS

For a better understanding of these and other objects of the present invention, reference will be made to the detailed description of the present invention which is to be read in association with the accompanying drawings, wherein.

DETAILED DESCRIPTION OF THE INVENTION

Figure 1:
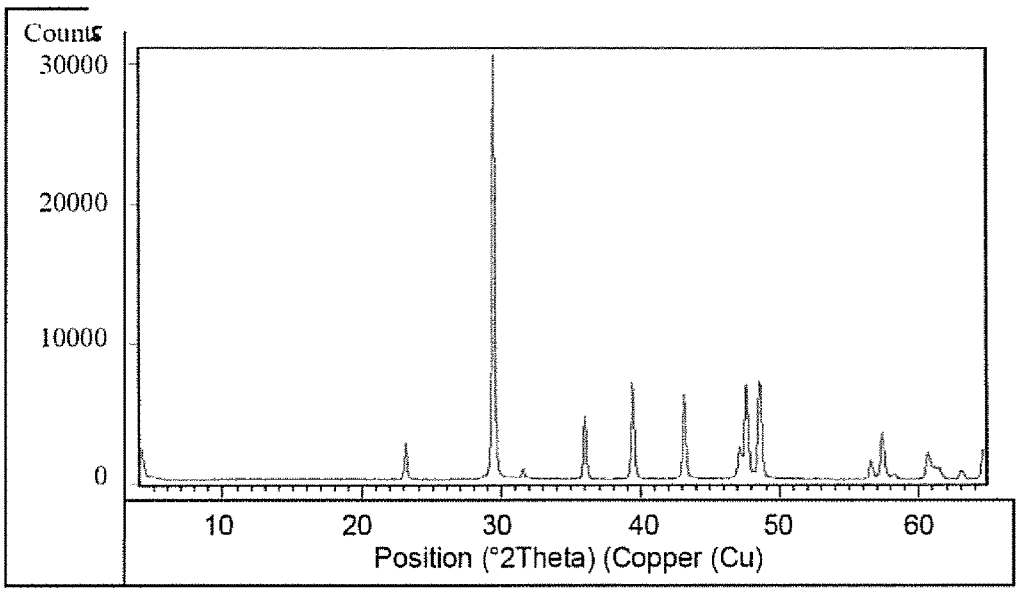
FIG. 1 shows a diffractogram of a starting calcium carbonate.

The subject of the present invention is therefore tobacco product wrapping materials comprising inventively used composite particles, which are obtainable by a method in which:

(a) an aqueous suspension containing calcium carbonate particles is prepared, and (b) a metal salt comprising an aluminum cation is added.

Within the scope of the present invention, calcium carbonate particles are set out in an aqueous suspension.

The suspension containing calcium carbonate particles prepared in step (a) preferably has a pH value in the range of 6.0-13.0, more preferably in the range of 6.0-11.0, measured in each case at 20° C.

In addition, the suspension containing calcium carbonate particles to be prepared in step (a) comprises preferably at least 1.0 wt. %, more preferably at least 5.0 wt. %, and especially 8.0-22.0 wt. %, of calcium carbonate, based in each case on the total weight of the suspension. Upon addition of suitable viscosity improvers known in themselves, however, significantly larger amounts of up to 75.0 wt. % of calcium carbonate are also conceivable.

In addition, the suspension can contain other mineral substances such as talc, kaolin, titanium dioxide, and magnesium oxide, wherein these mineral substances advisably are inert in the suspension at temperatures in the range of 10-90° C. and at the pH value of the suspension. The amount of these mineral substances in the suspension, based on the total weight of the suspension, however, is preferably less than 25.0 wt. %, more preferably less than 10.0 wt. %, and even more preferably less than 5.0 wt. %, most preferably less than 1.0 wt. %, and in particular less than 0.1 wt. %. Within the scope of an especially preferred embodiment of the present invention, the suspension contains no mineral substances in addition to the essential components stated in this application. According to the invention, "mineral substances" are understood to be chemical elements or chemical compounds in the form of crystallized components containing ultra-small units, which, regardless of any possible crystal defects and irregularities, are arranged in 3-dimensional periodic fashion and were formed by geological processes.

The origin of the calcium carbonate used is of minor importance for the present invention, and both natural ground calcium carbonate particles ("GCC") and precipitated calcium carbonate particles ("PCC") can be used, although the use of precipitated calcium carbonate particles is especially advantageous.

The form of calcium carbonate particles preferred for use, especially of precipitated calcium carbonate particles, is subject to no further restrictions in the invention and can be adjusted to suit the concrete purpose of the application. It is preferable, however, to use scalenohedral, rhombohedral, acicular, plate-like, or spherical particles. Within the scope of a quite especially preferred embodiment of the present invention, acicular (preferably aragonitic), rhombohedral (preferably calcitic), and/or scalenohedral (preferably calcitic) calcium carbonate particles, advisably acicular (preferably aragonitic) and/or scalenohedral (preferably calcitic) calcium carbonate particles, especially precipitated calcium carbonate particles, are used, wherein the use of scalenohedral (preferably calcitic) calcium carbonate particles, especially of precipitated scalenohedral (preferably calcitic) calcium carbonate particles are the most preferred of all.

The average diameter of the calcium carbonate particles being used, especially of the precipitated calcium carbonate particles, can in principle be freely selected. It is preferably in the range of 0.05-30.0 μm, and especially in the range of 0.1-15.0 μm.

In the case of scalenohedral calcium carbonate particles, the average diameter of the calcium carbonate particles is favorably in the range of 0.05-5.0 μm, preferably less than 3.0 μm, especially preferably less than 1.8 μm, and in particular less than 1.6 μm. In this case, furthermore, it is favorable for the average particle diameter to be greater than 0.1 μm, preferably greater than 0.3 μm, especially preferably greater than 0.6 μm, more preferably greater than 0.8 μm, and in particular greater than 1.0 μm.

The above-cited average particle sizes (based on weight) of the calcium carbonate particles used are advisably determined within the scope of the present invention by sedimentation analysis methods, wherein, in this relation, the use of a SediGraph 5100 (Micromeritics GmbH) is especially advantageous. This measurement parameter and all of the other measurement parameters cited in this application are preferably determined at 20° C. unless otherwise indicated.

The aqueous suspension can be produced in the known manner by mixing the components together. Alternatively, it is also possible to produce the suspension in situ by introducing a $CO_2$-containing gas, for example, into an aqueous lime slurry.

In step (b), a metal salt comprising an aluminum cation is added to the aqueous suspension, preferably to an aqueous calcium carbonate-containing suspension. The metal salt used, furthermore, is characterized in that it is able to form a basic aluminum component in situ, as it were, in the suspension.

Within the scope of the present invention, the aluminum cation-containing metal salt capable of forming a basic metal component, has, in water, measured at the pH value of the prepared suspension and at a temperature of 20° C., a solubility of greater than 9.0 mg/L, preferably of greater than 100.0 mg/L, more preferably greater than 500.0 mg/L, even more preferably greater than 1.0 grams per liter ("g/L"), favorably greater than 5.0 g/L, even more favorably greater than 100.0 g/L, and in particular greater than 400.0 g/L. In the following, therefore, it is occasionally referred to as a "water-soluble metal salt".

The metal salt capable of forming a basic metal component also preferably comprises less than 10.0 mole percent ("mol. %"), preferably less than 5.0 mol. %, favorably less than 1.0 mol. %, especially preferably less than 0.1 mol. %, and in particular no, i.e., 0.0 mol. % of anions different from hydroxide able to form salts with $Ca^{2+}$ ions, which salts, when measured in water at the pH value of the prepared suspension and at a temperature of 20° C., have a solubility of less than 5.0 g/L, preferably of less than 2.5 g/L, especially preferably of less than 2.0 g/L, and in particular of less than 1.0 g/L. Above all, the proportion of metal salts comprising sulfate and/or silicate ions should be as small as possible for the purposes of the present invention.

In view of the solubilities in water of the several salts summarized in the following table, the use of aluminum nitrate ("$Al(NO_3)_3$") is therefore especially preferred for the purposes of the present invention, whereas the use of aluminum hydroxide ("$Al(OH)_3$") as a water-soluble metal salt is not possible.

| Salt | Solubility in Water at 20° C. mg/L |
|---|---|
| $Al(NO_3)_3$ | 419,000 |
| $Al(OH)_3$ | 1.5 |
| $CaCl_2$ | 740,000 |
| $Ca(NO_3)_2$ | >1,470,000 |
| $CaSiO_3$ | practically insoluble |
| $Ca(OH)_2$ | 1,700 |
| $CaCO_3$ | 14 |

Additional metals salts especially suitable for the purposes of the present invention, i.e., metal salts capable of forming a basic metal component, include aluminum chloride, polyaluminum chloride, aluminum sulfate, aluminum nitrate sulfate, polyaluminum nitrate sulfate (Nicasol® from Sachtleben Wasserchemie), aluminum hydroxide chloride, aluminum hydroxide chloride sulfate, and aluminum hydroxide nitrate sulfate.

Aluminates have also proven to be especially suitable as metal salts. These are salts of aluminic acid $HAlO_2.H_2O$, in which aluminum forms a complex anion $[Al(OH)_4]^-$ with hydroxide ions as ligand, as well as salts in which the anion is in the form of a condensate of the aluminate ion. Especially preferred aluminates satisfy the general formula Met $[Al(OH)_4]$, where Met represents for a monovalent cation, especially sodium aluminate ($NaAl(OH)_4$) and potassium aluminate ($KAl(OH)_4$).

According to the invention, the addition of an aluminum salt has been found to be quite especially favorable.

The amount of the water-soluble metal salt to be added is preferably selected in such a way that the weight ratio of aluminum of the water-soluble metal salt to the mineral of the calcium carbonate particles is in the range of 0.01-25.0, preferably in the range of 0.1-20.0, especially preferably in the range of 0.2-15.0, and in particular in the range of 2.0-7.5.

The reaction of the components in step (b) is preferably carried out at a temperature in the range of 5-90° C., and preferably in the range of 15-30° C., and it leads preferably to the in-situ formation of the inventively used basic composite particles.

The inventively used composite particles precipitate from the reaction mixture under the above-described conditions and can be separated from the mother liquor in the known manner by, for example, filtration or centrifugation. For further purification, the composite particles can, if needed, be washed with water, acetone, and/or other suitable substances.

Within the scope of another preferred variant of the present invention, the suspension of the composite particles is used directly, without isolation of the inventively used composite particles, in the paper production process.

It is also possible to add a metal salt during the production of a calcium carbonate suspension from an aqueous $Ca(OH)_2$ suspension (milk of lime) by introducing $CO_2$. In this regard, a method is preferred in which (a) an aqueous $Ca(OH)_2$ suspension is prepared;

(b) a first quantity of $CO_2$-containing gas is introduced into the aqueous $Ca(OH)_2$ suspension;

(c) a metal salt comprising an aluminum cation is added;

(d) a second quantity of $CO_2$-containing gas is introduced into the reaction mixture; and (e) the composite particles being formed are isolated.

The methods described above lead to an incorporation of the basic metal component preferably forming in situ, into the prepared calcium carbonate particles. With respect to the pure basic metal components, the inventively used composite particles are preferably x-ray-amorphous; that is, the extent of the long-range order of the added basic metal components is below the coherence length of the x-ray radiation being used, especially below the coherence length of $CuK_\alpha$ radiation (wavelength: 154 pm).

X-ray diffraction studies of the inventively used composite particles therefore preferably show no Bragg reflections of the pure basic metal components, especially of aluminum hydroxide; on the contrary, they show, if any signals at all, only so-called signal humps, which reflect the normal Gaussian distribution of the average interatomic distances of the pure basic metal component.

Accordingly, x-ray diffraction spectra can be used, as a rule, to differentiate the inventively used composite particles from conventional mixtures of mineral particles and a basic metal component, especially of conventional mixtures of calcium carbonate and a basic metal component.

Thus especially in the case of aluminum-containing composite particles which contain calcitic calcium carbonate, an x-ray diffractogram of the inventively used composite particles will show a signal intensity at $2\theta=18.3\pm1.0$, preferably at $2\theta=18.3\pm0.5$, especially at $2\theta=18.3$, normally of less than 100.%, preferably of less than 75.0%, more preferably of less than 50.0%, favorably of less than 25.0%, advisably of less than 10.0%, even more favorably of less than 5.0%, quite especially preferably of less than 1.0%, and in particular of less than 0.1%, wherein the intensity of the signal at $2\theta=29.5\pm1.0$, especially at $2\theta=29.5\pm0.5$, and especially at $2\theta=29.5$, in the same x-ray diffractogram is defined as 100%.

For aluminum-containing composite particles which contain aragonitic calcium carbonate, an x-ray diffractogram of the inventively used composite particles will show a signal intensity at 2θ=18.3±1.0, preferably at 2θ=18.3±0.5, especially at 2θ=18.3, normally of less than 100.%, preferably of less than 75.0%, more preferably of less than 50.0%, favorably of less than 25.0%, advisably of less than 10.0%, even more favorably of less than 5.0%, quite especially preferably of less than 1.0% and in particular of less than 0.1%, where the intensity of the signal at 2θ=26.2±1.0, preferably at 2θ=26.2±0.5, and especially at 2θ=26.2 in the same x-ray diffractogram is defined as 100%.

The structural difference between the inventively used composite particles and conventional mixtures of mineral particles and a basic metal component, especially between the inventively used composite particles and conventional mixtures of calcium carbonate particles and a basic metal component, leads, furthermore, to a difference in behavior in the course of thermogravimetric studies between the inventively used composite particles and conventional mixtures of mineral particles and a basic metal component, especially conventional mixtures of calcium carbonate particles and a basic metal component. The inventively used composite particles, when heated from room temperature (20° C.) to over 200° C., preferably to over 300° C., and especially to over 450° C., release water continuously, whereas a mixture of mineral particles and $Al(OH)_3$, especially of PCC and $Al(OH)_3$, do not release significant quantities of water until a minimum temperature of greater than 200° C. is reached.

In this context, the thermogravimetric studies are preferably conducted in the range of 40-1,000° C. The heating rate is preferably 20° C./min. The inventively used composite particles, which preferably have a moisture content, measured at 130° C., of less than 5%, preferably of less than 4%, and especially of less than 3%, preferably show, in the thermogravimetric analysis in the range of 40-200° C. at a heating rate of 20 degrees Celsius per minute ("° C./min"), a weight loss of at least 0.4%, preferably of at least 5.0%, and especially of at least 10.0%.

The composition of the inventively used composite particles can, in principle, be selected freely and adapted to the concrete purpose of the application. In view of the purpose of the present invention, however, composite particles which, based in each case on the total weight of the composite particles, comprise (a) at least 23.2 wt. %, preferably at least 30.3 wt. %, especially preferably at least 34.8 wt. %, and in particular at least 37.3 wt. % of calcium;

(b) at least 34.8 wt. %, preferably at least 45.4 wt. %, especially preferably at least 52.0 wt. %, and in particular at least 55.8 wt. % of carbonate;

(c) at least 0.1 wt. %, preferably at least 0.5 wt. %, especially preferably at least 1.0 wt. %, and in particular at least 2.5 wt. %, of an aluminum cation; and (d) at least 0.1 wt. %, preferably at least 0.7 wt. %, especially preferably at least 1.3 wt. %, and in particular at least 3.5 wt. %, of hydroxide, have proven to be especially suitable.

The associated proportions of calcium, carbonate, and aluminum cation are preferably determined by x-ray fluorescence analysis. The amount of hydroxide is preferably determined by calculation of the difference from 100 wt. %.

For the purposes of the present invention, the BET surface area of the inventively used composite particles is preferably in the range of 0.1-100 $m^2/g$, preferably in the range from 1.0 $m^2/g$ to less than 25.0 $m^2/g$, especially preferably in the range from 2.5 $m^2/g$ to less than 20.0 $m^2/g$, and in particular in the range of 5.0-12.0 $m^2/g$.

The specific surface area (Brunauer-Emmett-Teller ("BET") surface area) of the composite particles is preferably determined by nitrogen adsorption by the use of the BET method. The use of a Micromeritics Gemini 2350 analyzer has been found to be especially suitable in this regard. The samples are advisably degassed at 130° C. for at least 3 hours, and especially for at least 12 hours, prior to the adsorption measurement, wherein the use of a FlowPrep 060 degasser is especially advantageous.

Possible areas of application of the inventively used composite particles are immediately obvious. They are suitable in particular as an additive to combustible substances to control their burning properties. They are therefore preferably used as an additive for controlling the burning properties of tobacco products.

The addition of the inventively used composite particles, furthermore, has a strong self-extinguishing effect, because the inventively used composite particles release water continuously, and in this way they extinguish the embers by themselves.

The application of the inventively used composite particles is therefore especially advantageous in tobacco products, especially in cigarettes.

For cigarette papers, tipping papers, and filter wrapping papers, the amounts of the inventively used composite particles added are usually selected to correspond to the content of the fillers usually used, wherein the amounts added are preferably in the range of 0.1-50.0 wt. %, and especially in the range of 0.2-45.0 wt. %, to guarantee that the burning properties are effectively controlled.

Within the scope of an embodiment of the present invention, the inventively used composite particles are used in tobacco product wrapping materials. Here the inventively used composite particles are preferably able, in addition to their function as filler, to give the tobacco product wrapping material controlled burning properties.

For this application, the inventively used composite particles usually have an average particle size in the range of 0.1-10 μm, preferably of 0.5-5 μm, and especially of 1-3 μm.

For this application, furthermore, the BET surface area of the inventively used composite particles is preferably in the range of 0.1-100 $m^2/g$, preferably in the range from 1.0 $m^2/g$ to less than 25.0 $m^2/g$, especially preferably in the range from 2.5 $m^2/g$ to less than 20.0 $m^2/g$, and in particular in the range of 5.0-12.0 $m^2/g$.

The total filler content of the inventive tobacco product wrapping material is typically in the range of 0.1-50 wt. %, usually of 0.2-45 wt. %, preferably of 10-45 wt. %, preferentially 15-40 wt. %, and in particular of 25-35 wt. %, based on the total weight of the tobacco product wrapping material.

In addition to the inventively used composite particles, the inventive tobacco product wrapping material can optionally contain additional fillers such as calcium carbonate, titanium dioxide, aluminum hydroxide, magnesium hydroxide, kaolin, calcined kaolin, and/or talc. The proportion of these additional fillers, based on the total weight of the tobacco product wrapping material, however, is preferably less than 25.0 wt. %, more preferably less than 10 wt. %, even more preferably less than 5.0 wt. %, favorably less than 1.0 wt. %, and in particular less than 0.1 wt. %.

The tobacco product wrapping material can be a cigarette paper, which surrounds the tobacco rod; a filter wrapping paper, which surrounds the filter; or a tipping paper (base paper for covering the filter material). It can also be a cigarette paper for nonfilter cigarettes to wrap the tobacco rod. In a preferred embodiment, the inventive tobacco product wrapping material is a cigarette paper. In another preferred embodiment, the inventive tobacco product wrapping material is a tipping paper.

The inventive tobacco product wrapping material, furthermore, can, if desired, contain additional components such as a combustion rate-retarding substance and/or a combustion rate-accelerating substance in an amount of 0.1-6%, and preferably of 0.3-3%.

Additional preferred, optional components are binders based on polysaccharides such as guar, galactomannan, starch and its derivatives, carboxymethylcellulose, wet-strength agents for temporary or permanent wet strength, and sizing agents for rendering the tobacco product wrapping material hydrophobic and for controlling the penetrability of the tobacco product wrapping material.

As needed, alkali metal or alkaline-earth metal salts such as sodium, potassium, and magnesium salts or carboxylic acid salts such as acetic acid, citric acid, malic acid, lactic acid, and tartaric acid salts, especially citric acid salts, can be used as combustion rate-accelerating substances.

Based in each case on the total weight of the tobacco product wrapping material, if a combustion rate-retarding and/or accelerating substance is used in the inventive tobacco product wrapping material it will usually be present in the range of 0-6 wt. %, and preferably of 0.5-3 wt. %.

Preferred base wrapping materials for the inventive tobacco product wrapping material usually consist of cellulose fibers obtained from flax, softwood, or hardwood, for example. To change the properties of the base wrapping material, if desired, various mixtures of cellulose fibers can be used as the base wrapping material.

The cellulose fibers used for producing the paper are usually divided into long and short fibers, where the long fibers are typically cellulose fibers from conifers such as spruce or pine with a length of more than 2 mm, whereas the short fibers originate from deciduous trees such as birch, beech, or *eucalyptus* and typically have a length of less than 2 mm, frequently of less than 1 mm.

In the absence of the inventively used composite particles, the inventive tobacco product wrapping material usually has an air permeability in the range of 5-200 CORESTA UNITS ("CU"), preferably of 20-130 CU, and especially of 30-90 CU. The addition of perforations of various types, which are worked into the inventive tobacco product wrapping material, can lead to tobacco product wrapping materials with air permeabilities of more than 200 CU.

The basis weight of the inventive tobacco product wrapping material is usually in the range of 10-120 g/m$^2$, preferably of 15-80 g/m$^2$, more preferably of 15-70 g/m$^2$, and even more preferably of 18-40 g/m$^2$.

The inventive tobacco product wrapping material is usually made on a papermaking machine such as a Fourdrinier machine.

In a first step of production, the pulp is usually suspended in water and then ground in a grinding unit, a so-called refiner. It is standard practice to grind short and long fibers separately. The extent to which the pulp has been ground is determined by measuring the fineness of the grinding according to, for example, ISO 5267 ("Pulps. Determination of Drainability. Part 1: Schopper-Riegler Method"). The result of this measurement is stated in degrees Schopper-Riegler ("° SR").

For application in inventive tobacco product wrapping materials, long-fiber pulp is typically ground to a fineness of 50-90°SR, and preferably to 70-80° SR.

Short-fiber pulp is usually ground to a much lesser extent and achieves a fineness of 20-60° SR, and preferably of 40-60° SR. It is also possible for short-fiber pulp not to be ground at all.

The pulp suspension thus produced is sent from a headbox of the paper machine to a draining screen, where it can be drained by various means such as by gravity or vacuum. Then the wet fiber network can be run through a pressing section, where it is drained further by mechanical pressure against a pressing felt. Finally, the fiber network can be sent to a drying section, where it passes along drying felts or drying screens, which press the fiber network against a hot drying drum—heated with steam, for example—and thus dry the fiber network. Instead of a drying section with drying drums, it is also possible to use a through-air drying or impacting-air drying process and/or some other type of convection drying. Then the finished tobacco product wrapping material is rolled up. If desired, additional processing steps can be conducted in the paper machine such as a sizing in a sizing or film press, the application of watermarks, embossing, etc.

The inventively used composite particles can be mixed into the pulp suspension before draining and/or into the pulp after draining by means of, for example, a sizing press or by spraying, and/or they can be applied to the surface of the inventive tobacco product wrapping material produced as described above by techniques such as soaking, spraying, printing, or brushing.

For the purposes of the present invention, a method for the production of an inventive tobacco product wrapping material is especially preferred which comprises the production of an inventive tobacco product wrapping material on a paper machine with the use of a pulp suspension which contains the inventively used composite particles.

In addition, a method for the production of an inventive tobacco product wrapping material is especially preferred which comprises the production of a tobacco product wrapping material on a paper machine, wherein, after draining, inventively used composite particles are added to the cellulose pulp in a sizing press and/or by any other desired type of application device.

In addition, a method for the production of an inventive tobacco product wrapping material is especially preferred which comprises the application of inventively used composite particles to a tobacco product wrapping material produced by means of a paper machine.

In a preferred embodiment, the inventively used composite particles are added to the pulp suspension. In another preferred embodiment, the inventively used composite particles are applied to the surface of an inventive tobacco product wrapping material produced by means of a paper machine, this application occurring either over the entire surface or only in special zones, preferably only in special zones, as will be described below.

In one embodiment, namely, one in which the tobacco product wrapping material is a tipping paper, it is possible to omit the use of additional fillers beyond the inventively used composite particles in the tipping paper. The quantity of inventively used composite particles in a tipping paper of this type, namely, one which contains these particles as filler, can conventionally be in the range of 0.1-50 wt. %, usually of 0.2-45 wt. %, and preferably of 10-45 wt. %.

In another embodiment, namely, one in which the inventive tobacco product wrapping material is a filter wrapping paper, it is possible to omit the use of any other fillers besides the inventively used composite particles in the filter wrapping paper. The quantity of inventively used composite particles in a filter wrapping paper of this type, namely, one which contains these particles as filler, can conventionally be in the range of 0.1-50 wt. %, usually 0.2-45 wt. %, and preferably 10-45 wt. %.

In another embodiment, namely, one in which the inventive tobacco product wrapping material is a cigarette paper, the inventively used composite particles can be used in conventional amounts of 0.1-50 wt. %, usually of 0.2-45 wt. %, and preferably of 10-45 wt. %, based on the weight of the cigarette paper, as the only filler; or it can be used as one component of a filler mixture, wherein the entire amount of filler is conventionally 0.1-50 wt. %, usually 0.2-45 wt. %, and preferably 10-45 wt. %, based on the weight of the cigarette paper, and the proportion of the inventively used composite particles is 20-99%, preferably 50-99%, and especially 60-99%, based on the weight of the filler mixture. The filler mixture can be a mixture of the inventively used composite particles and an additional filler, preferably precipitated calcium carbonate produced by a precipitation reaction, for example, between calcium hydroxide and carbon dioxide.

Through incorporation of a filler mixture of this type into the inventive tobacco product wrapping material, it is possible to modify the normally combustion-promoting effect of the additional filler such as precipitated calcium carbonate by adding the inventively used composite particles, which have a combustion-slowing effect, in suitable proportions of more than 20%, preferably of more than 50%, based on the weight of the filler mixture, to cancel out the combustion-promoting effect, for example, wherein it has been found that this effect, according to the invention, begins at proportions of greater than 30% of the inventively used composite particles based on the weight of the filler mixture. Thus it is possible effectively to control the burning properties of the inventive tobacco product wrapping material, e.g., to control the combustion rate of the cigarette paper and thus the number of puffs characterizing tobacco products such as cigarettes without having to change any of the other parameters of the cigarette paper such as its basis weight, air permeability, or type and quantity of burn-regulating salt. This measure can be used to obtain a tobacco product with a balanced sensory result.

In another embodiment, the inventive tobacco product wrapping material can be a cigarette paper containing discrete zones in which the air permeability of the base wrapping material is changed (so-called "LIP" [Lower Ignition Propensity] cigarette papers). In one embodiment, these discrete zones with changed air permeability are zones with an air permeability of 0-30 CU, preferably of 3-15 CU, and especially of 3-10 CU.

In one embodiment, the inventive tobacco product wrapping material to which the above-mentioned discrete zones are applied, i.e., zones in which the air permeability of the base wrapping paper is changed, can be a tobacco product wrapping material into which the inventively used composite particles have been incorporated or, alternatively, in another embodiment, a tobacco product wrapping material which does not contain the inventively used composite particles. In a preferred embodiment, discrete zones are applied to an inventive tobacco product wrapping material, these zones containing the inventively used composite particles in an amount of 5-20 wt. %, based on the total weight of the applied separate zones, wherein the inventive tobacco product wrapping material to which the discrete zones are applied contain the inventively used composite particles in an amount of 15-40% based on the total weight of the inventive tobacco product wrapping material.

The discrete zones can be formed by application of a burn-regulating salt such as the one mentioned above and/or by application of the inventively used composite particles and/or by application of a mixture of inventively used composite particles and an additional filler such as calcium carbonate and/or by application of a mechanically fragmented, chemically crosslinked polysaccharide, possibly in conjunction with the inventively used composite particles.

In a preferred embodiment, discrete zones are applied to an inventive tobacco product wrapping material which contains a combustion rate-retarding substance and possibly the inventively used composite particles, wherein the substance to be applied to form the discrete zones also contains the combustion rate-retarding substance, so that the inventive tobacco product wrapping material comprising the discrete zones is characterized in that the content of the combustion rate-retarding substance in the areas in the discrete zones is different from that outside the discrete zones.

In another preferred embodiment, discrete zones are applied to an inventive tobacco product wrapping material which contains a combustion rate-changing substance and possibly inventively used composite particles, wherein the substance to be applied to form the discrete zones contains a combustion rate-changing substance which is different from the combustion rate-retarding substance contained in the tobacco product wrapping material, so that the inventive tobacco product wrapping material comprising the discrete zones is characterized in that the type of combustion rate-changing substance in the areas in the discrete zones is different from that outside the s discrete zones.

In another preferred embodiment, discrete zones are applied to an inventive tobacco product wrapping material which contains inventively used composite particles, wherein the discrete zone-forming substance to be applied also contains inventively used composite particles, so that the inventive tobacco product wrapping material comprising the discrete zones is characterized in that the content of inventively used composite particles in the areas in the discrete zones is different from that outside the discrete zones.

In another preferred embodiment, discrete zones are applied to an inventive tobacco product wrapping material which contains inventively used composite particles, wherein the discrete zone-forming substance to be applied contains a mechanically fragmented, chemically crosslinked polysaccharide, so that the inventive tobacco product wrapping material comprising the discrete zones is characterized in that the content of inventively used composite particles in the areas in the discrete zones is not different from that outside the discrete zones.

As a result of the incorporation of the inventively used composite particles into the inventive tobacco product wrapping material prior to application of discrete zones, it is possible, especially when, for example, a mechanically fragmented, chemically crosslinked polysaccharide is applied in discrete zones, that the mechanically fragmented, chemically crosslinked polysaccharide in the discrete zones can be used in smaller amounts than before to lower the air permeability to, for example, 3-15 CU. An inventive tobacco product wrapping material comprising an air permeability which has been reduced in the discrete zones is thus also characterized in that the discrete zones are much less visible or not visible at all to the human eye.

In addition, in the case of this type of inventive tobacco product wrapping material with discrete zones of decreased air permeability, the sensory difference between the discrete zones and the areas outside the discrete zones perceived when the tobacco product is smoked is less pronounced than in the case of conventional cigarette papers without the inventively used composite particles and with correspondingly strongly pronounced differences between the discrete zones and the areas outside the discrete zones.

As the mechanically fragmented, chemically crosslinked polysaccharide, it is possible to use a mechanically fragmented and chemically crosslinked starch, modified starch, starch derivative, cellulose, cellulose derivative, chitosan, chitosan derivative, chitin, chitin derivative, alginate, alginate derivative, or a combination of these compounds, preferably a mechanically fragmented, chemically crosslinked starch.

A mechanically fragmented, chemically crosslinked polysaccharide is understood to be a polysaccharide which has been reduced to small particles by a shearing action and then expanded by the use of, for example, an extruder, wherein this polysaccharide can also be subjected to a wide variety of chemical reactions such as oxidation or reduction.

Thus, when a starch in granular form is used as starting material, it is possible to use a natural starch; a starch which has been denatured by oxidation, heat, or hydrolysis; or a chemically modified ether or ester derivative thereof.

Ionized polysaccharide derivatives can be produced with the following cationization or anionization agents in the substitution range of 0.02-0.1 (D.S.): 3-chloro-2-hydroxypropyltrimethylammonium chloride, 2,3-epoxypropyltrimethylammonium chloride, 3-chloro-2-hydroxypropyldimethyldodecylammonium chloride, 3-chloro-2-hydroxypropyldimethyloctadecylammonium chloride, sodium monochloroacetate, acetic anhydride, and/or maleic anhydride.

For crosslinking, a bifunctional or polyfunctional agent which can react with at least two free hydroxyl groups of the polysaccharide molecule, preferably in an amount of 0.1-0.8 wt. % calculated on the basis of the weight of the polysaccharide in granular form, is reacted with the starch grains. The bifunctional or polyfunctional agent to be used is usually selected from the group consisting of aliphatic epoxyhalogen or dihalogen compounds, phosphoroxyhalides, alkali metaphosphates, aldehydes including aldehyde-containing resins, acid anhydrides, and polyfunctional reagents such as cyanuric acid chloride.

Chemical modification reactions can be conducted both prior to extrusion and in the extruder. It can be useful to perform them prior to extrusion, because dispersions with smaller fragments are obtained after fragmentation in the extruder and subsequent dispersion of the ground product in water.

The starches can preferably originate from tuber or root starches and from grain starches as starting material. Typical tuber and root starches are potato starch and tapioca starch, whereas readily available grain starches include cornstarch and wheat starch. The starches to be used are not limited in any way to these starches, however; the advantage of the previously mentioned starches is merely that they are currently easy to obtain commercially. It is obvious that mixtures of two or more starches selected from the group consisting of natural starch; oxidatively, thermally, or hydrolytically denatured starch; and chemically modified tuber, root, or grain starches can be used. Tuber, root, or grain flours can also be used as raw material. By means of an extruder (both single-screw and twin-screw extruders are suitable), it is possible to achieve a defined fragmentation of, for example, potato starch grains, wherein the finished, dry product is ground to a grain size of less than 2 mm, and preferably of less than 1 mm, with an average particle size of approximately 500 μm.

The mechanical and thermal decrease in the size of the crosslinked polysaccharide grains leads to fragments with surfaces which do not consist of ordered molecular regions but rather of loose, partially hydrolyzed polysaccharide strands. This layer, which becomes "soft" when allowed to swell in water, makes it possible to obtain larger contact areas for the process of depositing the fragments onto fibers and thus to obtain a stronger bond of the polysaccharide particles to the fibers.

The composition to be applied to the inventive tobacco product wrapping material can optionally contain a solvent in addition to the agent responsible for the air permeability of the tobacco product wrapping material.

Water and/or an organic solvent can be used as this solvent. Suitable organic solvents include, for example, isopropanol, ethanol, dimethylacetamide, N-methylpyrrolidone, and/or N-methylmorpholine-N-oxide.

Optionally, the composition to be applied to the inventive tobacco product wrapping material can also contain other components such as additional substances for changing the air permeability of the base wrapping material, fillers, combustion rate-retarding substances, and/or combustion rate-accelerating substances.

Additional substances for changing the air permeability of the base wrapping material which can be mentioned include in particular a polysaccharide which has not been subjected to mechanical fragmentation and chemical crosslinking such as starch, modified starch, starch derivatives, cellulose, cellulose derivatives, chitosan, chitosan derivatives, chitin, chitin derivatives, alginate, alginate derivatives, and combinations of these compounds.

The proportions of the various components in the composition to be applied to the inventive tobacco product wrapping material, based in each case on the weight of the solid content of the composition, can be, for example:

- 20-100%, preferably 45-100%, and especially preferably 70-100%, of chemically crosslinked, mechanical fragmented polysaccharide, especially starch;
- possibly 0-40%, and preferably 0-20%, of a conventionally used polysaccharide;
- possibly 0-50%, and preferably 0-30%, of a filler; and
- optionally 0-6%, and preferably 0-3% of the combustion rate-retarding and/or accelerating substance.

The application of the composition to the tobacco product wrapping material is usually carried out after the production of the base tobacco product wrapping material by means of a spray or printing technique, for example, preferably by a gravure printing technique. These methods are well known to the person skilled in the art in the relevant technical area and are also described in detail in the patent literature, so that there is no need here for a detailed description of the application methods which can be used.

In another, especially preferred embodiment of the present invention, the application of the composition to the inventive tobacco product wrapping material can be carried out by application through a pressure nozzle with a discharge slit which is usually transverse to the discharge direction. The pressure nozzle which can be used is usually a nozzle with an interior chamber under an inlet pressure; with controlled, fast-acting valves, which control the feed into the nozzle slit; and with a nozzle and discharge slit geometry adapted to the desired application.

The use of such a pressure nozzle makes it possible to apply the material continuously or discontinuously to the inventive tobacco product wrapping material in the discrete areas required for the described use or over the entire surface of the tobacco product wrapping material. For the desired application, it is also possible to combine several separately controllable individual nozzles in modular form.

As long as the viscosity of the application medium is sufficient, the method offers uniform coatings with clear and precisely defined leading and trailing edges. Because this is not a spray process, there is no undesirable spattering of the applied material outside the discrete areas.

The application of the composition to be applied to the inventive tobacco product wrapping material according to one or more of the above-described application methods is usually carried out at least in discrete zones of the tobacco product wrapping material, or, if desired, over the entire tobacco product wrapping material.

The rate at which the composition is applied to the inventive tobacco product wrapping material is usually in the range of 0.1-10 $g/m^2$, and preferably of 0.3-5 $g/m^2$ of the tobacco product wrapping material.

The application is usually carried out in such a way that the material applied to the inventive tobacco product wrapping material obtained is almost or entirely invisible, and the treated zones have a smooth, level appearance, which is essentially the same as that of the untreated zones. The width and spacing of the applied zones depend on a number of different variables such as the air permeability of the tobacco product wrapping material, the density of the composition of the tobacco rod, the cigarette design, etc. The zones usually have a width of at least 3 mm, and preferably of 5-10 mm.

The distance between the zones also depends on a number of variables. The distance between the zones should usually be 1-35 mm, and preferably 10-25 mm.

In the normal case, the inventive tobacco product wrapping material (in rolled form) contains 1-3 treated ring-shaped zones, which are spaced apart as described above.

Within the scope of another aspect of the present invention, the previously described inventive tobacco product wrapping material is used for the production of tobacco products.

It will generally be the case that the inventive tobacco product wrapping material has a decreased air permeability in the area of these zones, as a result of which the cigarette will self-extinguish in this area if there is an obstacle to the free access of air. To measure the self-extinguishing tendency, a generally recognized standard such as the National Institute of Standards and Technology ("NIST") test according to NIST Technical Note 1436, is usually used. In addition, a test for free burning, which is conventional in the general technical field, can also be conducted, in which a cigarette is fastened to a holder allowing free access to air and then lit once. In a successful test for free burning, the cigarette burns down completely in the holder after being lit; it does not go out. If this does not happen and the cigarette goes out before it has burned completely down, the cigarette does not pass or only partially passes this test.

The inventively used composite particles can be used in inventive tobacco product wrapping materials of any desired air permeability, because the particle size, the shape, and other important parameters of the inventive composite particles can be brought into harmony with those of substances conventionally used as fillers, especially with precipitated calcium carbonate. Other fillers which also have a combustion-reducing effect cannot cover this wide range of air permeabilities of cigarette paper or are not permitted under the applicable legal regulations.

In the following, the present invention is illustrated in more detail by means of examples and comparison examples, but there is no intention of limiting the idea of the invention to them.

Measurement Methods

Electron Microscope

The scanning-electron images were made with a high-voltage electron microscope (Zeiss, DSM 962) at 15 kilovolts ("kV"). A layer of a gold-palladium was sprayed onto the samples.

Thermoravimetry (TGA)

The thermogravimetry was conducted with a PerkinElmer STA 6000 under nitrogen (nitrogen flow rate: 20 mL/min) in the range of 40-1,000° C. at a heating rate of 20° C./min.

Burn Hole Test

A loop of wire about 1 millimeter ("mm") in diameter is heated to 550° C. and introduced horizontally to a strip of paper, namely, the tobacco product wrapping paper to be tested, which is clamped in a vertical position. The loop is kept in this position during the measurement. The temperature of the hot wire loop is measured with a temperature sensor and kept at 550° C. The hot wire loop burns the paper, forms a burn hole, and initiates the burning process. The increase in the horizontal size of the burn hole diameter minus the diameter of the wire loop results in the growth of the burn hole and is expressed in mm. The burn hole test was conducted 5 times with each sample of paper.

Oxygen Index

The oxygen index (abbreviated OI or LOI=Limiting Oxygen Index) is a characteristic used to describe the combustion behavior of plastics. It is the minimum oxygen concentration of an oxygen-nitrogen mixture at which the combustion of a vertically mounted sample persists under the test conditions.

The sample for which the oxygen index is to be determined is ignited from above in a vertical glass tube, through which an oxygen-nitrogen mixture flows. After the ignition flame is removed, the combustion behavior is observed. If the flame burns for more than 180 seconds or reaches a point 50 mm below the measurement mark at the top edge, the oxygen concentration is decreased in the following test or, in the contrary case, increased. This is continued until 50% of the samples burn at a certain concentration.

Sedimentation Analysis

Determination of the particle size distribution with a SediGraph 5100.

Test Procedure

The particle size distribution is determined by measuring the sedimentation rate of the test substance. The measurement itself proceeds on the basis of the attenuation of an x-ray beam, which is sent through the suspension. At the beginning, the attenuation is high, and later, as the suspension becomes "thinner", the beam can pass through it more easily as sedimentation begins; that is, the attenuation decreases.

Equipment, Chemicals general laboratory equipment;
SediGraph 5100 with Master-Tech 51 from Micromeritics; and
dispersing solutions, 0.5% and 0.1% sodium polyphosphate (NPP) in completely deionized water.

Method

1. Preparation

First the sample is prepared by taring the sample container on a balance, weighing in or pipetting the sample quantity in according to Table 1, and making up the dispersing solution according to Table 1 to a total of about 80 grams ("g").

TABLE 1

| Sample | Amount Weighed In | Dispersing Agent |
|---|---|---|
| Powder | 3.0 g | 0.1% NPP |
| PCC suspension, with a concentration of about 160 g of $CaCO_3$/L* | 20.0 g | 0.5% NPP |
| PCC suspension, with a concentration of about 120 g of $CaCO_3$/L* | 25.0 g | 0.5% NPP |

*The amount weighed in is always based on 3 g of absolutely dry material; the amount must be adjusted in cases where the solids content deviates significantly from this.

2. Measurement and Evaluation

The SediGraph is used to perform the measurement and the evaluation. The software calculates the particle size distribution.

Example 1

Raw Materials Used:
20 g of calcium carbonate suspension in water crystal structure: calcite/scalenohedral particle size (sedimentation analysis, SediGraph): $d_{50}$=approx. 1.5 μm; <1 μm=approx. 19%, pH value: 8-9 solids content (gravimetric): 17% specific surface area (BET): 9 $m^2/g$
1.12 kilograms (kg") polyaluminum chloride solution (12.5% Al±0.3%, commercial product PAX-XL 19 from Kemira)
Equipment:
Dispermat dissolver from Emod with propeller agitator mixing container, approx 25 liters ("L"), without baffle 20.0 kg of a 14 wt. % aqueous calcium carbonate suspension was prepared and stirred at 450 revolutions per minute ("rpm"). Under continuous stirring, 1120 g of PAX-XL 19 was then quickly added, and the stirring speed was increased to 1,000 rpm. When the viscosity visibly decreased, the speed was reduced to 450 rpm. The suspension was stirred for 20 min. At the end of precipitation, the pH was between 6 and 7.

Analysis

The suspension was filtered by means of a suction filter (d=26 cm) and a blue-stripe filter ("42" quantitative), and the filter cake was washed with completely deionized water until, by flocculation with silver nitrate in the known manner, no more chloride ions were detected in the filtrate. The moist filter cake was dried in a circulating-air compartment dryer at 100° C. until the weight was constant. Then the dried filter cake was ground in a pin mill (UPZ from Alpine at 220 V).

Analysis Data of the Powder

| Powder | Specific surface area $m^2/g$ | Moisture content % |
|---|---|---|
| Starting calcium carbonate | 9 | 0.4 |
| Composite particles | 21 | 2.9 |

Figure 2:
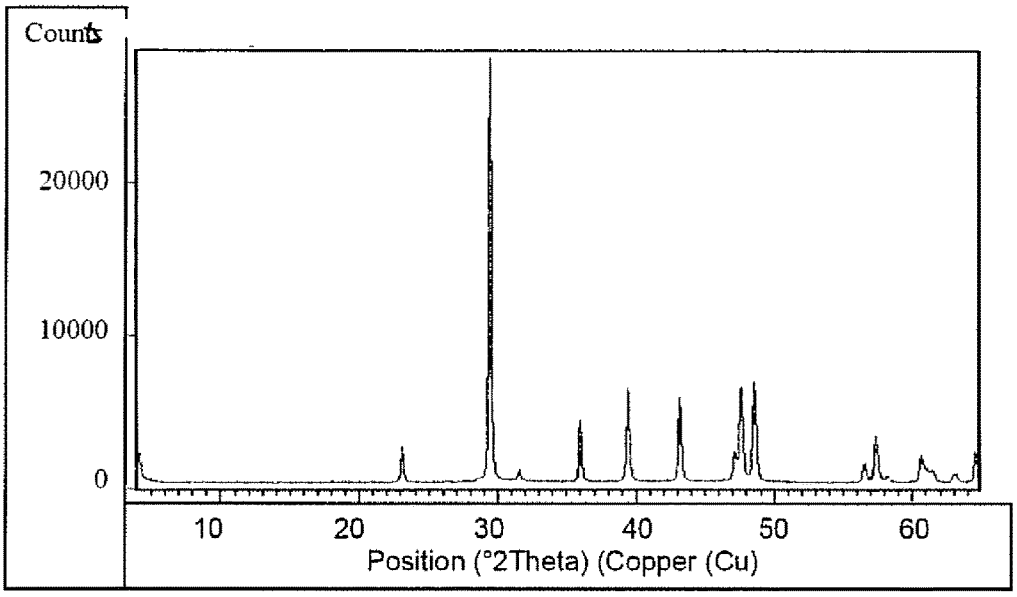
FIG. 2 shows a diffractogram of a composite particle.
Figure 3:
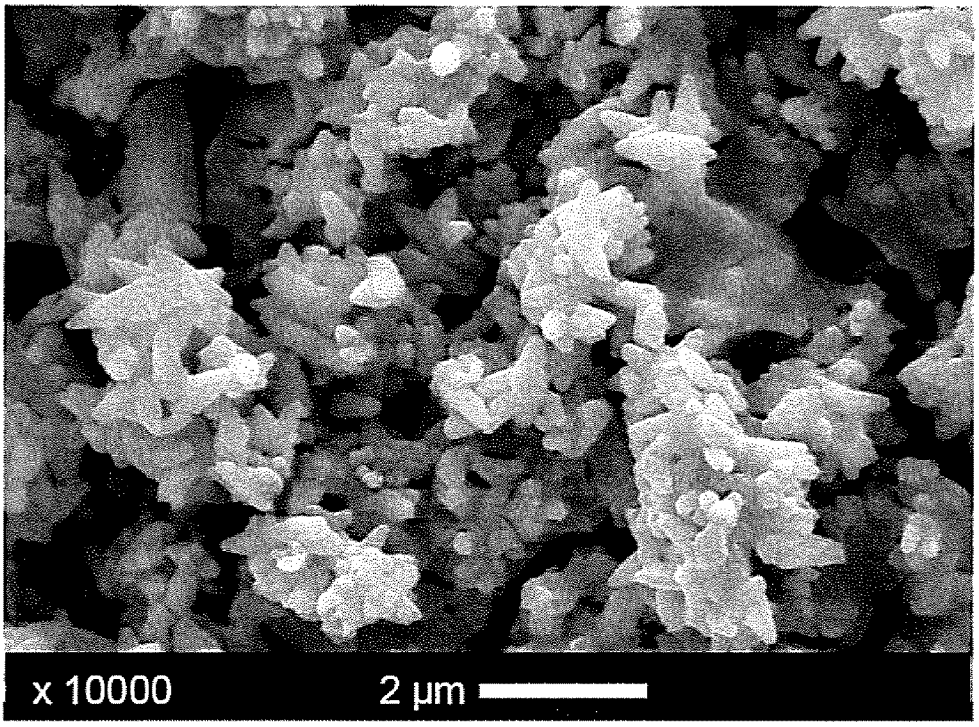
FIG. 3 shows a REM image of the composite particle.
Figure 4:
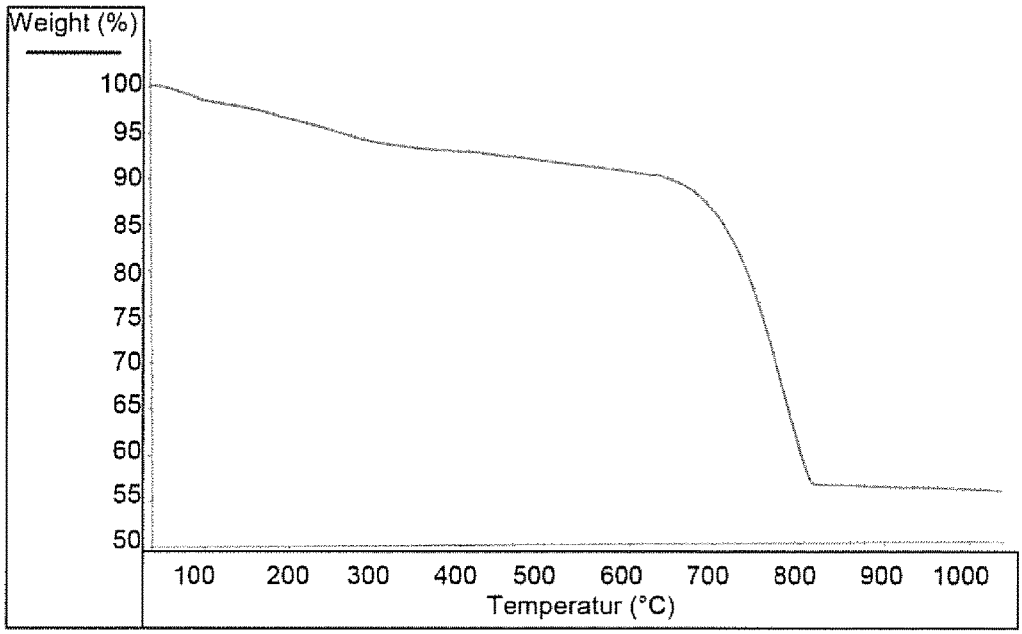
FIG. 4 shows a TGA curve of the composite particle.

FIG. 1 shows the diffractogram of the starting calcium carbonate; FIG. 2 shows the diffractogram of the composite particle. FIG. 3 shows an REM image of the composite particle; and FIG. 4 shows the TGA curve of the composite particle.

Comparison Example 1

750 g of the calcium carbonate suspension of Example 1 was mixed with 15.2 g of aluminum hydroxide (Alfrimal from Alpha), stirred for 15 minutes, and dried as previously described at 130° C.

Figure 5:
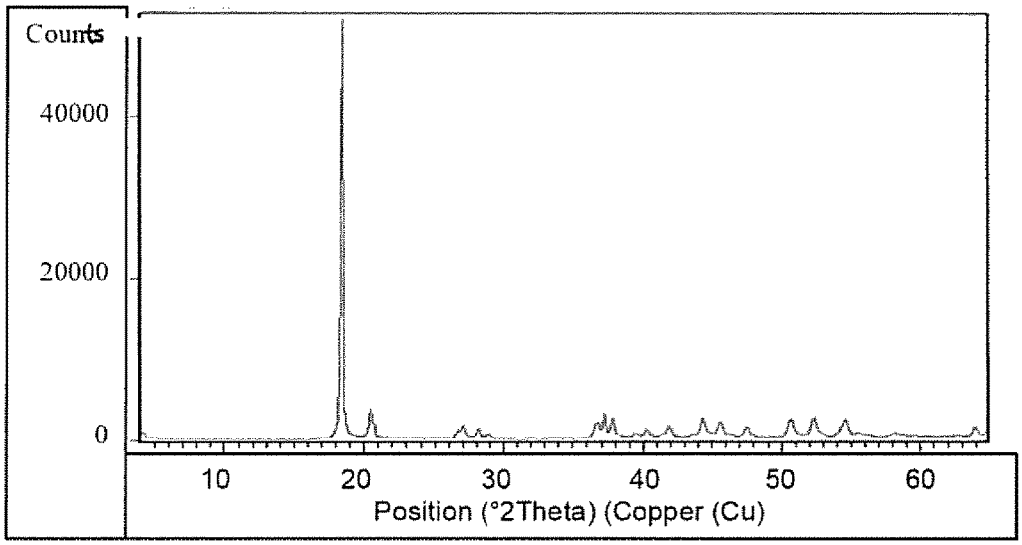
FIG. 5 shows a diffractogram of aluminum hydroxide.
Figure 6:
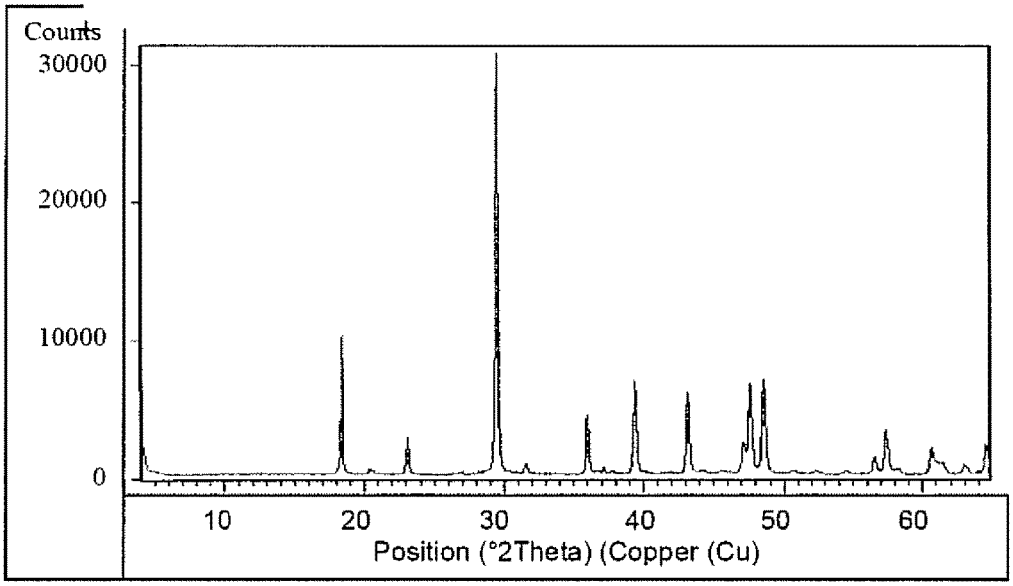
FIG. 6 shows a diffractogram of a mixture of aluminum hydroxide and calcium carbonate.
Figure 7:
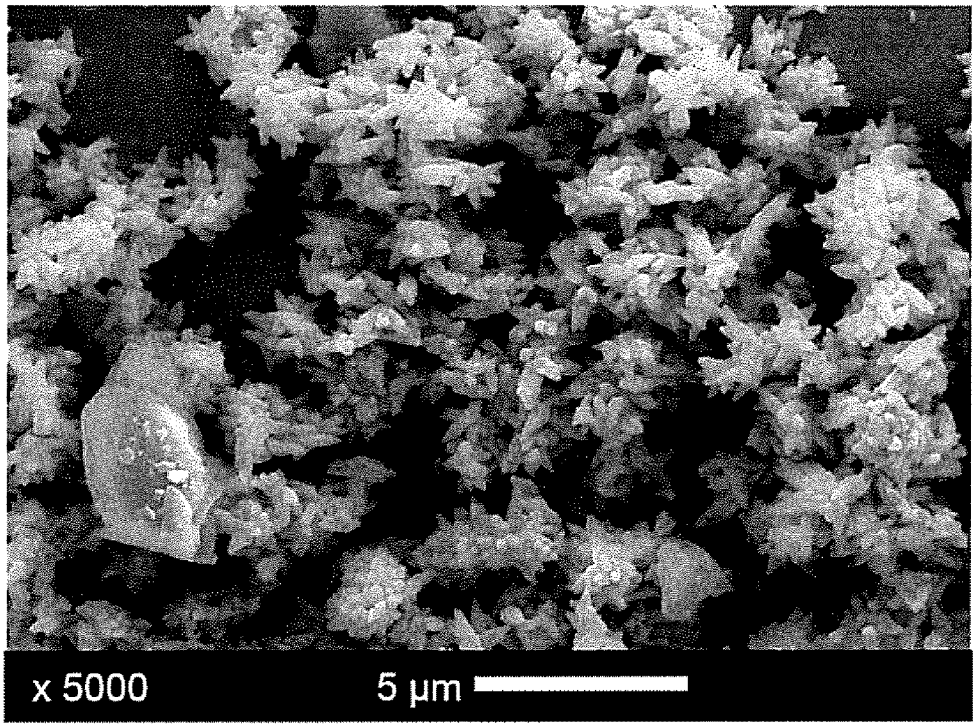
FIG. 7 shows a REM image of the mixture of aluminum hydroxide and calcium carbonate.

FIG. 5 shows the diffractogram of the aluminum hydroxide; FIG. 6 shows the diffractogram of the resulting mixture. FIG. 7 shows an REM image of the resulting mixture.

In contrast to the inventively used composite particles, the diffractogram of the mixture of calcium carbonate and aluminum hydroxide shows signals for aluminum hydroxide such as those at 2θ=18.3; in the REM image, the aluminum hydroxide is clearly recognizable.

Figure 8:
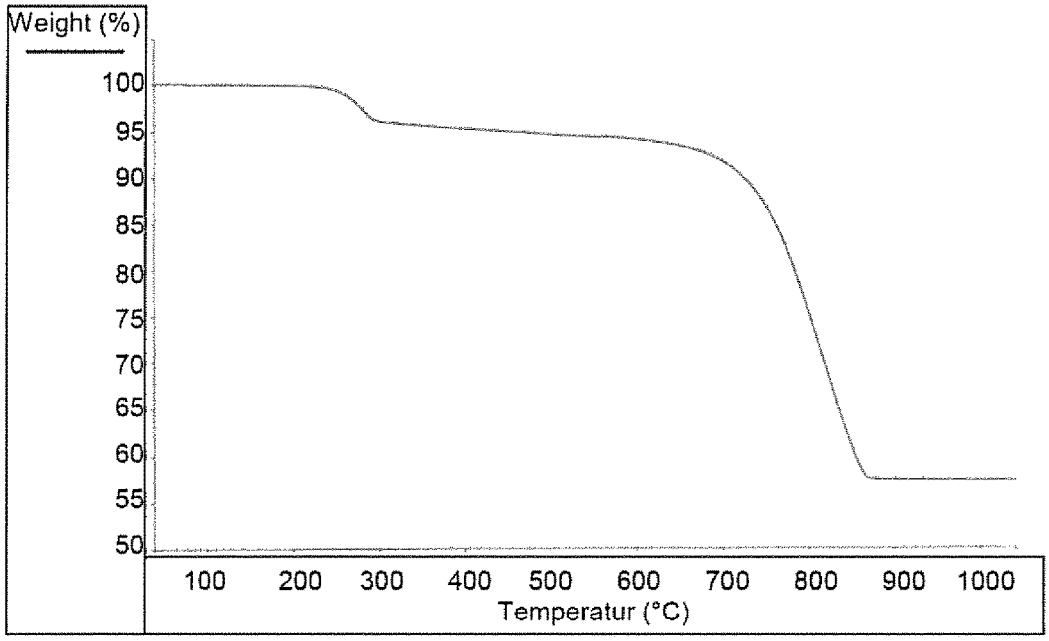
FIG. 8 shows a TGA curve of the mixture of aluminum hydroxide and calcium carbonate.

FIG. 8 shows the TGA curve of the resulting mixture. In contrast to the inventively used composite particles, the mixture of calcium carbonate and aluminum hydroxide does not release water until the temperature is above 200° C.

Example 2

Procedure as in Example 1 with the use of 0.09 kg of PAX-XL 19.

Analysis Data of the Powder

| Powder | Specific surface area $m^2/g$ | Moisture content % |
|---|---|---|
| Starting calcium carbonate | 9 | 0.4 |
| Composite particles | 10 | 0.6 |

Comparison Example 2

Calcium Carbonate Suspension:
crystal structure: calcite/scalenohedral
particle size (sedimentation analysis, SediGraph): $d_{50}$=approx. 1.5 μm; <1 μm=approx. 19%
pH value: 8-9
solids content (gravimetric): 17%
specific surface area (BET): 9 $m^2/g$ Example 3

Procedure as in Example 1 with the use of the following:
Calcium Carbonate Suspension:
crystal structure: calcite/scalenohedral
particle size (sedimentation analysis, SediGraph): $d_{50}$=approx. 2.95 μm; <1 μm=approx. 0.47%
pH value: 8-9
solids content (gravimetric): 17%
specific surface area (BET): 6 $m^2/g$ Analysis Data of the Powder

| Powder | Specific surface area $m^2/g$ | Moisture content % |
|---|---|---|
| Starting calcium carbonate | 6 | 0.4 |
| Composite pigment | 11 | 2.7 |

Example 4

Procedure as in Example 3 except that, instead of 1.12 kg of polyaluminum chloride solution, only 0.56 kg of polyaluminum chloride solution was used.

Analysis Data of the Powder

| Powder | Specific surface area $m^2/g$ | Moisture content % |
|---|---|---|
| Starting calcium carbonate | 6 | 0.4 |
| Composite pigment | 9 | 1.8 |

Example 5

Raw materials used: 6 kg of calcium carbonate suspension in water crystal structure: calcite/scalenohedral particle size (sedimentation analysis, SediGraph): $d_{50}$=approx. 2.0 μm; <1 μm=approx. 7% pH value: 8-9 solids content (gravimetric): 13.8% specific surface area (BET): 7 $m^2/g$ 0.964 kg aluminum sulfate solution (4.3% Al, commercial product ALS from Kemira) Equipment: Dispermat dissolver from Emod with propeller agitator mixing container, approx 10 L, without baffle 6 kg of 14 wt. % aqueous calcium carbonate suspension was prepared and stirred at 450 rpm. Then, under continuous stirring, 964 g of ALS was added quickly, and the speed was increased to 1,000 rpm. As soon as the viscosity visibly decreased, the speed was reduced to 450 rpm again. The suspension was stirred for 20 min. At the end of precipitation, the pH value was between 6 and 7.

Analysis

The suspension was filtered through a suction filter (d=26) and a round blue-stripe filter ("42" quantitative), and the filter cake was washed with completely deionized water until, by flocculation with silver nitrate in the known manner, no more chloride ions were observed in the filtrate. The moist filter cake was dried in a circulating air compartment dryer at 100° C. until its weight was constant. Then the dry filter cake was ground in a pin mill (UPZ from Alpine at 220 Volts).

Analysis Data of the Powder

| Powder | Specific surface area $m^2/g$ | Moisture content % |
|---|---|---|
| Composite pigment | 16 | 3.6 |

Example 6

Procedure as in Example 5 except that, instead of 0.964 kg of aluminum sulfate solution, 0.767 kg of aluminum nitrate sulfate solution (5.4% Al; commercial product Nicasal from Sachtleben) was used.

Analysis Data of the Powder

| Powder | Specific surface area $m^2/g$ | Moisture content % |
|---|---|---|
| Composite pigment | 11 | 4.2 |

Example 7

Procedure as in Example 5 except that, instead of 0.964 kg of aluminum sulfate solution, 0.796 kg of aluminum chloride solution (5.2% Al, commercial product Sachtoklar P from Sachtleben) was used.

Analysis Data of the Powder

| Powder | Specific surface area $m^2/g$ | Moisture content % |
|---|---|---|
| Composite pigment | 27 | 2.9 |

Examples 8 and 9 and Comparison Example 3

On a Fourdrinier machine, various tobacco product wrapping papers were produced from a long-fiber pulp (⅔ Aspa-⅓ Stendal, fineness of grinding 75° SR). The composite particles were added to the headbox in such a quantity that the tobacco product wrapping paper contained the composite particles in an amount of 25 wt. %, based on the total weight of the wrapping paper. In addition, 1.1 wt. % of burn-regulating salt (sodium-/potassium citrate=1:1), based on the total weight of the tobacco product wrapping material, was incorporated. Into the comparison tobacco product wrapping paper of Comparison Example 3, the calcium carbonate suspension produced in Comparison Example 2 was incorporated in such an amount that the proportion of calcium carbonate, based on the total weight of the wrapping material, was 25 wt. %. The basis weight of the tobacco product wrapping papers thus produced was 30 $g/m^2$. The quantity of burn-regulating salt in the papers, the burning time, and the results of the burn hole test are summarized in the immediately following table:

| | Pigment | Burn-Regulating Salt, Wt. % | Burning Time (seconds ("s")) | Burn Hole, mm |
|---|---|---|---|---|
| Comp. Ex. 3 | Comparison Example 2 | 1.17 | 63 | 7-∞ |
| Example 8 | Example 2 | 1.09 | 72.5 | 4 |
| Example 9 | Example 1 | 1.15 | 76 | 2 |

The sample of Comparison Example 3 achieved a burn hole increase of more than 5 mm; in some samples, the entire paper burned up (infinite increase in the size of the burn hole). Through the addition of the inventively used composite particles in Examples 8 and 9, the burn hole increase becomes progressively smaller and is held at less than 5 mm (mean value from 5 tests). These 5 mm are considered a recognized boundary in the relevant technical field for being able to call a tobacco product wrapping paper as exhibiting "reduced combustion" (less than or equal to 5 mm). In the case of a burn hole increase of more than 5 mm, the tobacco product wrapping paper is not said to exhibit "reduced combustion".

Examples 10 and 11 and Comparison Examples 4 and 5

In analogy to Example 8, tobacco product wrapping papers were produced with the composite particles of Example 2.

Tobacco product wrapping papers with a filler content of 25%, a basis weight of 30 g/m$^2$, and an air permeability of 15-150 CU were produced. The pulp component, which constituted 75 wt. % of the tobacco product wrapping paper, consisted of ground long-fiber pulp with a fineness of 65-84° SR for preparation of the above-mentioned air permeability range. The quantity of burn-regulating salt in the papers, the burning time, and the results of the burn hole test are summarized in the immediately following table:

| | Pigment | Burn-Regulating Salt, wt. % | Burning Time, s | Burn Hole, mm |
|---|---|---|---|---|
| Comp. Ex. 4 | Comparison Example 2 | 0 | 0[1] | ∞ |
| Comp. Ex. 5 | Comparison Example 2 | 1 | 60 | ∞ |
| Example 10 | Example 1 | 0 | 0[1] | <5 |
| Example 11 | Example 1 | 1 | 70 | <5 |

[1]Could not be measured. Self-extinguished.

Examples 12-14 and Comparison Example 6

The wrapping papers described in Comparison Example 5 and Example 10 were provided with special bands (LIP [Lower Ignition Propensity] bands) for the self-extinguishing test of cigarettes; the diffusion capacity of the bands was 0.16 cm/s, Experience has shown that this is a range in which it is possible to analyze the effects of the various fillers on the self-extinction of the cigarette on a filter paper consisting of 10 layers (see ASTM values) and the propensity of the cigarette to self-extinguish under free burning conditions (surrounded only by free air and not lying on a substrate) (see FASE [Free Air Self-Extinction] values); and it is also a range in which it possible to differentiate among the fillers on the basis of the FASE values. All of the studied samples achieved the 100% ASTM specifications with a band diffusion of 0.16 cm/s in each case. The composition of the studied materials and the observed FASE values are summarized in the immediately following table:

| | Pigment in the Cigarette Paper | Pigment in the LIP Coating | FASE % |
|---|---|---|---|
| Comp. Ex. 6 | Comparison Example 2 | — | 60 |
| Example 12 | Comparison Example 2 | Example 1 (8 wt. %) | 40 |
| Example 13 | Example 1 | — | 100 |
| Example 14 | Example 1 | Example 1 (8 wt. %) | 20 |

The lower the FASE value (20% FASE means that 80% of all cigarettes continue to burn in a free environment) with an ASTM value of greater than 75% at the same time, the more advantageous the evaluation of such cigarettes by the cigarette manufacturer and the smoker.

The paper sample of Example 14 with composite particles in the cigarette paper and also as a component of the LIP band material achieved here the best result in comparison to standard PCC, followed by the paper sample of Example 12 (composite particles in the LIP coating).

Example 15 and Comparison Examples 8 and 9

On a Fourdrinier machine, various tobacco product wrapping papers were produced from a long-fiber pulp (⅔ Aspa-⅓ Stendal, fineness of grinding 75° SR). The composite particles were added to the headbox at such a rate that the tobacco product wrapping paper contained the composite particles in an amount of 25 wt. % based on the total weight of the wrapping paper. In the comparison tobacco product wrapping paper of Comparison Example 8, the calcium carbonate suspension produced in Comparison Example 2 was incorporated in such an amount that the proportion of calcium carbonate based on the total weight of wrapping material was 25 wt. %. Into the comparison tobacco product wrapping paper of Comparison Example 9, a mixture of the calcium carbonate suspension produced in Comparison Example 2 and aluminum hydroxide in a ratio of 90:10 (based on weight) was incorporated in such an amount that the proportion of calcium carbonate and aluminum hydroxide in the mixture, based on the total weight of the wrapping material, was 25 wt. %. In addition, a quantity of 1.2 wt. % of burn-regulating salt (sodium-/potassium citrate=1:1) based on the total weight of the tobacco product wrapping material was incorporated into the tobacco product wrapping papers. The basis weight of the produced tobacco product wrapping papers was 30 g/m$^2$. The burning time and the results of the burn hole test are summarized in the immediately following table:

| | Pigment | Burn-Regulating Salt, wt. % | Burning Time, s | Burn Hole, mm |
|---|---|---|---|---|
| Comp. Ex. 8 | Comparison Example 2 | 1.17 | 63 | 7-∞ |
| Comp. Ex. 9 | 90% Comp. Ex. 2 + 10% aluminum hydroxide (Afrimal, Alpha) | 1.20 | 69 | 6 |
| Example 15 | Example 1 | 1.15 | 76 | 2 |

The mixture of 90% calcium carbonate and 10% aluminum hydroxide in tobacco product wrapping papers (Comparison Example 9) is efficient in comparison to Comparison Example 8 with only calcium carbonate as pigment with respect to increasing the burning time (decreasing the burning rate) and reducing the size of the burn hole, but it is much less efficient than Example 15 (composite particles). The air permeability was 100 CU.

What is claimed is:

1. A tobacco product wrapping material comprising composite particles obtained according to a method comprising:

(a) preparing an aqueous suspension containing calcium carbonate particles; and (b) adding a metal salt to the aqueous suspension, wherein the metal salt comprises at least one of aluminum nitrate, polyaluminum chloride, and aluminum nitrate sulfate and further wherein the metal salt:

(i) forms a basic metal component in the suspension; and (ii) has a solubility of greater than 9.0 mg/L in water, measured at the pH value of the prepared suspension and at a temperature of 20° C.

2. A tobacco product wrapping material according to claim 1, characterized in that, in an x-ray diffractogram of the composite particles, the signal intensity at $2\theta=18.3\pm1.0$ is less than 100.0%, wherein the intensity of the signal at $2\theta=29.5\pm1.0$ is defined as 100.0%.

3. A tobacco product wrapping material according to claim 1, characterized in that, in an x-ray diffractogram of the composite particles, the signal intensity at $2\theta=18.3\pm1.0$ is less than 100.0%, wherein the intensity of the signal at $2\theta=26.2\pm1.0$ is defined as 100.0%.

4. A tobacco product wrapping material according to claim 1, characterized in that the composite particles have a BET surface area in the range from 0.1 $m^2/g$ to less than 25 $m^2/g$.

5. A tobacco product wrapping material according to claim 1, characterized in that the composite particles are present in amounts of 1-50 wt. % based on the total weight of the tobacco product wrapping material.

6. A tobacco product wrapping material according to claim 1, characterized in that the tobacco product wrapping material is a tipping paper.

7. A tobacco product wrapping material according to claim 1, characterized in that the tobacco product wrapping material is a filter wrapping paper.

8. A tobacco product wrapping material according to claim 1, characterized in that the tobacco product wrapping material is a cigarette paper.

9. A tobacco product wrapping material according to claim 8, characterized in that the cigarette paper contains discrete zones of reduced air permeability.

10. A tobacco product wrapping material according to claim 9, characterized in that the discrete zones of the cigarette paper contain a mechanically fragmented, chemically crosslinked polysaccharide with a particle size, defined as the weight-average particle size of the dry product, in the range of 1-1,000 μm.

11. A tobacco product wrapping material according to claim 10, wherein the mechanically fragmented and chemically crosslinked polysaccharide is a mechanically fragmented and chemically crosslinked starch.

12. A tobacco product wrapping material according to claim 10, characterized in that the discrete zones of the cigarette paper also contain composite particles according to the definition of claim 1 and possibly additional fillers in addition to the mechanically fragmented, chemically crosslinked polysaccharide with a particle size, defined as the weight-average particle size of the dry product, in the range of 1-1,000 μm.

13. A tobacco product wrapping material according to claim 11, characterized in that the discrete zones of the cigarette paper also contain said composite particles and, optionally, additional fillers in addition to the mechanically fragmented, chemically crosslinked polysaccharide with a particle size, defined as the weight-average particle size of the dry product, in the range of 1-1,000 μm.

14. The method of claim 1, wherein the pH value of the prepared aqueous suspension is between 6.0 and 13.0.

15. A method for the production of a tobacco product wrapping material, wherein the method comprises:

forming a pulp suspension, wherein the pulp suspension comprises a cellulose pulp and composite particles, wherein the composite particles are obtained according to a method comprising:

(a) preparing an aqueous suspension containing calcium carbonate particles; and (b) adding a metal salt to the aqueous suspension, wherein the metal salt comprises an aluminum cation, and further wherein the metal salt:

(i) forms a basic metal component in the suspension; and (ii) has a solubility of greater than 9.0 mg/L, in water, measured at the pH value of the prepared suspension and at a temperature of 20° C.;

draining the pulp suspension; and drying the pulp suspension.

16. The method of claim 15, wherein the pH of the prepared aqueous suspension is between 6.0 and 13.0.

17. A tobacco product, characterized in that it comprises a tobacco product wrapping material comprising composite particles obtained according to a method comprising:

(a) preparing an aqueous suspension containing calcium carbonate particles; and (b) adding a metal salt to the aqueous suspension, wherein the metal salt comprises at least one aluminum nitrate, polyaluminum chloride, and aluminum nitrate sulfate, and further wherein the metal salt:

(i) forms a basic metal component in the suspension; and (ii) has a solubility of greater than 9.0 mg/L in water, measured at the pH value of the prepared suspension and at a temperature of 20° C.

18. A method for the production of a tobacco product wrapping material, wherein the method comprises:

forming a cellulose pulp suspension;

draining the cellulose pulp suspension to form a wet fiber network;

drying the wet fiber network to form a fiber network;

providing composite particles formed according to a method comprising:

(a) preparing an aqueous suspension containing calcium carbonate particles; and (b) adding a metal salt to the aqueous suspension, wherein the metal salt comprises at least one of aluminum nitrate, polyaluminum chloride, and aluminum nitrate sulfate, and further wherein the metal salt:

(i) forms a basic metal component in the suspension; and (ii) has a solubility of greater than 9.0 mg/L in water, measured at the pH value of the prepared suspension and at a temperature of 20° C.; and applying the composite particles to the fiber network using at least one of a sizing press application, a spray application, and a spray nozzle application.

19. The method of claim 18, wherein the pH of the prepared aqueous suspension is between 6.0 and 13.0.

* * * * *